US008901468B2

(12) United States Patent
Bravo

(10) Patent No.: US 8,901,468 B2
(45) Date of Patent: Dec. 2, 2014

(54) ELECTROMAGNETIC ENERGY HEATING SYSTEM

(76) Inventor: Vincent A. Bravo, Haskell, NJ (US)

( * ) Notice: Subject to any disclaimer, the term of this patent is extended or adjusted under 35 U.S.C. 154(b) by 147 days.

(21) Appl. No.: 13/445,399

(22) Filed: Apr. 12, 2012

(65) Prior Publication Data

US 2013/0270262 A1 Oct. 17, 2013

(51) Int. Cl.

| | |
|---|---|
| ***H05B 6/80*** | (2006.01) |
| ***H05B 6/64*** | (2006.01) |
| ***H05B 6/70*** | (2006.01) |
| ***H05B 3/60*** | (2006.01) |
| ***F22B 1/30*** | (2006.01) |
| ***F24H 7/00*** | (2006.01) |
| ***F24H 7/02*** | (2006.01) |
| ***F22B 1/02*** | (2006.01) |
| ***F25B 29/00*** | (2006.01) |
| ***F24F 3/14*** | (2006.01) |
| ***F25B 13/00*** | (2006.01) |
| ***E01C 19/45*** | (2006.01) |

(52) U.S. Cl.

USPC ..... 219/687; 219/759; 219/760; 219/688; 219/689; 219/678; 219/679; 219/680; 219/681; 219/690; 219/691; 219/692; 219/693; 219/694; 219/695; 219/696; 219/697; 219/756; 219/757; 392/314; 392/322; 392/324; 392/339; 392/341; 392/342; 165/58; 165/59; 165/60; 165/61; 165/62; 165/63; 165/64; 165/65; 165/66; 126/344; 126/363.1; 99/324; 99/450

(58) Field of Classification Search

USPC ..... 219/687, 759, 760, 688–697, 678, 219/679–681, 756–757; 392/314, 322, 324, 392/339, 341, 342; 165/58–66; 126/344–363.1

See application file for complete search history.

(56) References Cited

U.S. PATENT DOCUMENTS

| | | | | |
|---|---|---|---|---|
| 2,419,439 | A * | 4/1947 | Cook | 336/57 |
| 2,549,366 | A | 4/1951 | Bostik | |
| 2,917,701 | A * | 12/1959 | Salton | 361/37 |
| 2,947,798 | A * | 8/1960 | Guglielmo et al. | 174/15.1 |
| 2,978,562 | A | 4/1961 | Fox | |

(Continued)

FOREIGN PATENT DOCUMENTS

| | | | |
|---|---|---|---|
| GB | 2356752 | A | 5/2001 |
| WO | 2007059618 | A1 | 5/2007 |

OTHER PUBLICATIONS

International Search Report and Written Opinion for Application No. PCT/US2013/036149 dated Jul. 10, 2013.

International Search Report, PCT/US08/10588, dated Dec. 1, 2008.

*Primary Examiner* — Dana Ross

*Assistant Examiner* — Gyounghyun Bae

(74) *Attorney, Agent, or Firm* — Lerner, David, Littenberg, Krumholz & Mentlik, LLP

(57) ABSTRACT

A heating system for hot water and conditioned air uses electromagnetic energy created by one or more magnetrons operated by high voltage transformers. The heating system includes oil cooled transformers and magnetrons. Using radiators in the form of heat exchangers, heat recovered from the transformers and magnetrons is dissipated directly into the path of the return air and the air handler blower. The magnetron heating system includes a coiled conduit sized to allow complete heating of the fluid flowing therethrough. The conduit has a conical shape to allow upper magnetrons to heat the outside of the conduit and lower magnetrons to heat the inside of the conduit.

19 Claims, 10 Drawing Sheets

(56) References Cited

U.S. PATENT DOCUMENTS

| | | | | | |
|---|---|---|---|---|---|
| 3,170,519 | A | * | 2/1965 | Haagensen | 166/60 |
| 3,211,880 | A | * | 10/1965 | Johnson | 219/745 |
| 3,315,121 | A | * | 4/1967 | Staats | 315/39.51 |
| 3,377,562 | A | * | 4/1968 | Staats | 315/5.13 |
| 3,812,315 | A | | 5/1974 | Martin | |
| 3,891,817 | A | * | 6/1975 | Brown | 219/688 |
| 3,920,945 | A | | 11/1975 | Smith et al. | |
| 4,107,501 | A | * | 8/1978 | Ironfield | 219/710 |
| 4,152,567 | A | | 5/1979 | Mayfield | |
| 4,305,329 | A | | 12/1981 | Fenoglio | |
| 4,358,652 | A | | 11/1982 | Kaarup | |
| 4,417,116 | A | | 11/1983 | Black | |
| 4,481,396 | A | | 11/1984 | Matsubayashi et al. | |
| 4,593,169 | A | | 6/1986 | Thomas | |
| 4,618,756 | A | | 10/1986 | Schwaderer et al. | |
| 4,666,113 | A | * | 5/1987 | Itoh et al. | 248/201 |
| 4,771,156 | A | | 9/1988 | Strattan et al. | |
| D301,733 | S | | 6/1989 | Mansfield | |
| D303,704 | S | | 9/1989 | Cunningham | |
| 4,940,869 | A | | 7/1990 | Scholtes et al. | |
| 4,956,534 | A | | 9/1990 | Martin | |
| 5,179,259 | A | * | 1/1993 | Martin | 219/688 |
| 5,180,896 | A | * | 1/1993 | Gibby et al. | 219/687 |
| 5,323,086 | A | | 6/1994 | Shiota | |
| 5,490,398 | A | * | 2/1996 | Cline | 62/497 |
| 5,799,822 | A | * | 9/1998 | Rudewicz et al. | 221/150 HC |
| 6,064,047 | A | | 5/2000 | Izzo | |
| 6,376,817 | B1 | * | 4/2002 | McFadden et al. | 219/681 |
| 6,858,824 | B1 | | 2/2005 | Monteleone et al. | |
| 7,061,360 | B2 | | 6/2006 | Richardson et al. | |
| 7,109,453 | B1 | | 9/2006 | Nadolski | |
| 8,000,102 | B2 | * | 8/2011 | Johnston et al. | 361/699 |
| 2002/0011487 | A1 | | 1/2002 | Matsuo et al. | |
| 2004/0149742 | A1 | | 8/2004 | Lescano | |
| 2005/0061807 | A1 | * | 3/2005 | Cotten et al. | 219/688 |
| 2005/0139594 | A1 | | 6/2005 | Jones et al. | |
| 2005/0230385 | A1 | | 10/2005 | Lee et al. | |
| 2006/0049184 | A1 | | 3/2006 | Garboski | |
| 2007/0062935 | A1 | | 3/2007 | Dawson et al. | |
| 2008/0283520 | A1 | | 11/2008 | Monteleone et al. | |
| 2009/0084779 | A1 | | 4/2009 | Bravo | |
| 2009/0134152 | A1 | * | 5/2009 | Sedlmayr | 219/687 |
| 2009/0230124 | A1 | * | 9/2009 | Senn | 219/679 |
| 2010/0006565 | A1 | * | 1/2010 | Ben-Shmuel et al. | 219/704 |
| 2011/0192164 | A1 | * | 8/2011 | Farkaly | 60/670 |

* cited by examiner 138
132
136
124
134
126
128
142
140
150
150
112
148
116
130
114
128
118
122
148
120
150
150
148
146
144

100
104
124
136
172
102
180
106
186
186
192
188
190
168

ELECTROMAGNETIC ENERGY HEATING SYSTEM

BACKGROUND OF THE INVENTION

The present invention relates in general to an electromagnetic energy heating system adapted for residential, commercial, and industrial applications. More particular, by way of example, the present invention relates to the use of microwave energy created by one or more magnetrons as a heat source for heating fluids to an elevated temperature for heat exchange applications.

Electromagnetic energy such as in the form of microwaves generated by a magnetron have been known for use in heating systems having various designs. By way of example, United States Pub. No. 2005/0139594 discloses the application of a magnetron in a water heater or boiler. U.S. Pat. No. 4,956,534 discloses the application of a magnetron in a heat exchanger having a frustoconical shape. See also U.S. Pat. No. 6,858,824 which discloses a microwave domestic hot water and radiant heating system.

The present invention provides a heating system using electromagnetic energy generated from one or more magnetrons in a manner heretofor unknown, which is described in the following detailed description.

BRIEF SUMMARY OF THE INVENTION

The present invention is generally directed to an electromagnetic energy heating system using one or more transformer operated magnetrons for generating microwave energy to produce economical and energy saving heat. For example, the system can be figured to use microwave energy to provide domestic hot water, as well as to heat a building, structure or other space to be conditioned in residential, commercial, and industrial applications.

In accordance with one embodiment of the present invention, there is disclosed an electromagnetic energy heating system, comprising: a housing forming an internal chamber in communication with an inlet and an outlet; a fluid heating unit within the chamber for heating a fluid therein; a magnetron for creating electromagnetic energy in communication with the heat exchange for heating the fluid therein; a transformer operably connected to the magnetron for the operation thereof; and a cooling system comprising a first circulation system for circulating cooling fluid between the magnetron and a magnetron heat exchanger, and a second circulating system for circulating cooling fluid between the transformer and a transformer heat exchanger.

In accordance with a further embodiment of the present invention there is disclosed an electromagnetic energy heating system comprising; a housing forming an internal chamber; a heating unit having a fluid therein formed from a coiled conduit having a conical shape within the chamber, the coiled conduit having an exterior surface area and an interior surface area, the coiled conduit including an upper end having a diameter smaller than a diameter of a lower end of the coiled conduit, the lower end having an opening in communication with the interior surface area of the coiled conduit; a first magnetron for creating electromagnetic energy directed toward the exterior surface area of the coiled conduit for heating the fluid therein; and a second magnetron for creating electromagnetic energy directed toward the interior surface area of the coiled conduit for heating the fluid therein.

In accordance with still another embodiment of the present invention there is disclosed an electromagnetic energy heating system, comprising: a housing forming an internal chamber in communication with an air inlet and an air outlet; a fluid heating unit within the chamber for heating a fluid therein; a system within the chamber operable for generating electromagnetic energy for heating fluid within the heating unit, the system creating heat within the chamber while generating electromagnetic energy; and an air passageway defined within the chamber between the air inlet and the air outlet in communication with the system; wherein air received through the air inlet and discharged through the air outlet is conditioned within the chamber by the heat created by the system.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects and advantages thereof may best be understood by reference to the following detailed description when read with the accompanying drawings in which:

DETAILED DESCRIPTION OF THE PREFERRED EMBODIMENTS

Figure 1:
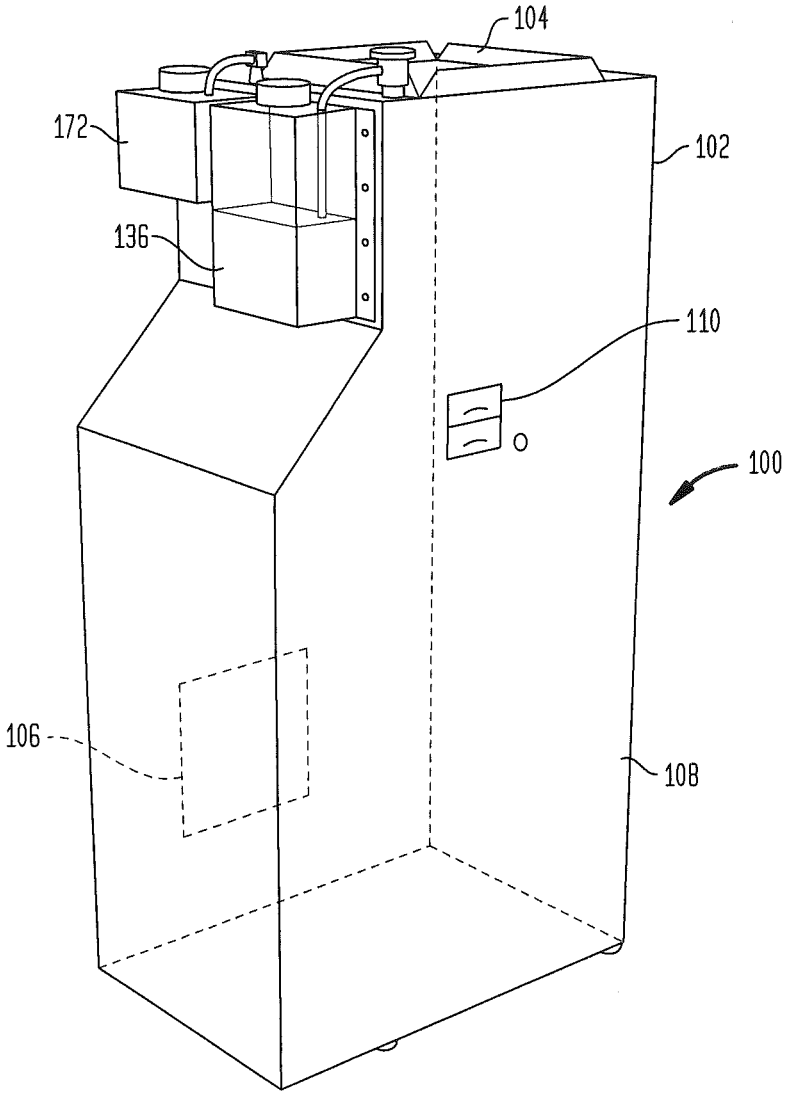
FIG. 1 is a perspective view of an electromagnetic energy heating system in accordance with one embodiment of the present invention, as illustrated within a housing or cabinet.

In describing the preferred embodiments of the invention illustrated in the drawings, specific terminology will be used for the sake of clarity. However, the invention is not intended to be limited to the specific terms so used, and it is to be understood that each specific term includes all equivalence that operate in a similar manner to accomplish a similar purpose.

Figure 9:
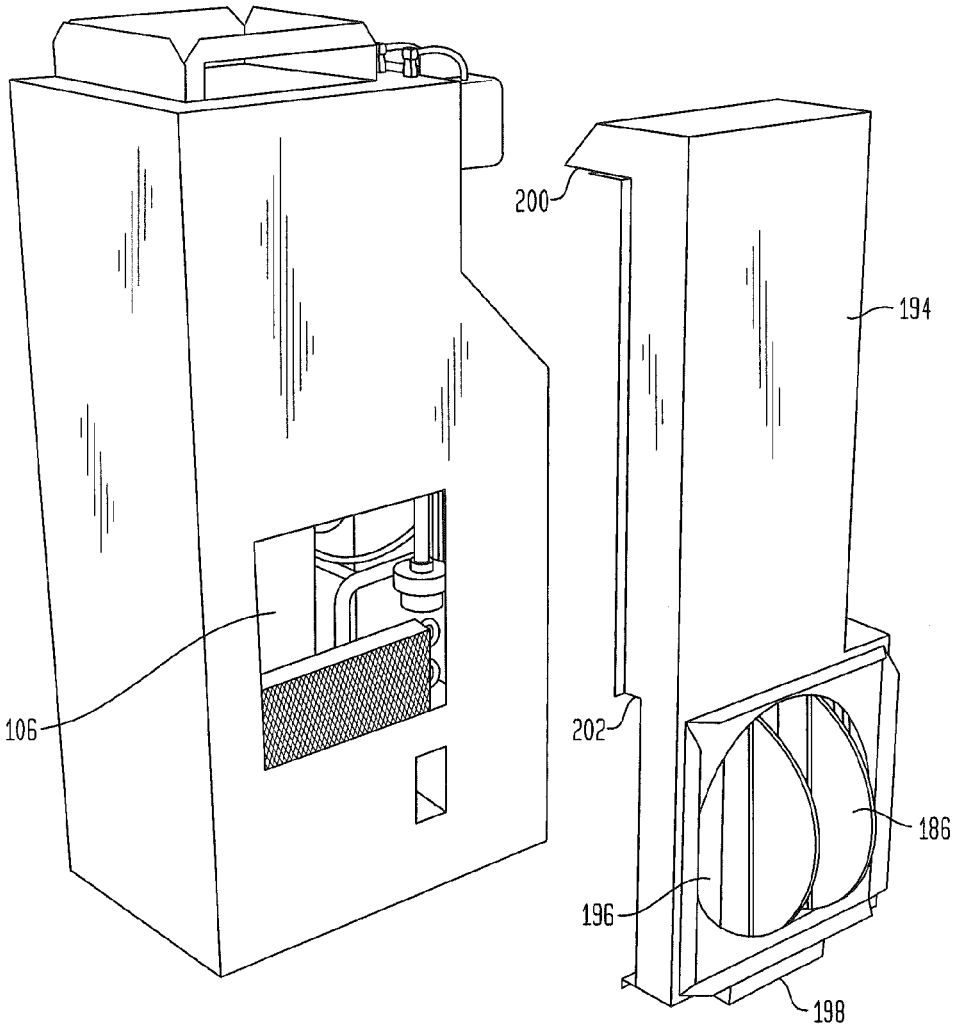
FIG. 9 is a perspective partial unassembled view of the heating system housing having a regenerative heat recovery duct in accordance with one embodiment of the present invention.

Referring now to FIG. 1, wherein like reference numerals represent like elements, there is shown an electromagnetic energy heating system in accordance with one embodiment of the present invention generally designated by the reference numeral 100. The heating system 100 includes a housing 102 or cabinet constructed to contain the operative components, assemblies, sub-assemblies, systems, and subsystems as to be described hereinafter. The housing is constructed to include a discharge air outlet 104 and a return air inlet 106 as shown in FIG. 9. Although the air outlet 104 is illustrated arranged at the top of the housing 102, and the air inlet 106 is arranged on a side panel of the housing, other arrangements of the outlet and inlet are contemplated pursuant to the present invention.

In addition, the housing 102 may include a removable service panel 108 to provide access to the interior of the housing for servicing the components, assemblies, sub-assemblies, systems and sub-systems therein. The service panel 108 may be provided with a key lock to prevent access to the interior of the housing by unauthorized individuals. A control panel 110 having a microprocessor for the operation of the heating system 100 may be provided on one of the side panels of the housing 102. The operation of the heating system 100 may be controlled manually or programed by the control panel 110, or remotely through a wireless connection to the control panel such as the Internet or through another wired or nonwired network.

The housing 102, in accordance with the preferred embodiment, is substantially sealed except for the air outlet 104 and air inlet 106. That is, the heating system 100 communicates with the surrounding environment substantially through the air outlet 104 and air inlet 106. In this regard, the housing 106 provides a substantially enclosed environment sealed from the surrounding environment where the heating system is placed.

As will be understood from a further description of the heating system 100, the use of electromagnetic energy created by magnetrons does not produce any toxic exhaust or combustion flue gases that require venting to the atmosphere. Therefore, there are no combustion flue ducts as conventionally found in gas or oil burning systems. For this reason, the heating system 100 can be placed anywhere within any open or closed area to be occupied without concern of contamination of the breathable air. The absence of combustion flue ducts provides the heating system 100 with a degree of portability for use not only in permanent installations, but in temporary installations such as portable localized heating systems where temporary conditioned heated air is required, for example, at work sights and the like.

Figure 2:
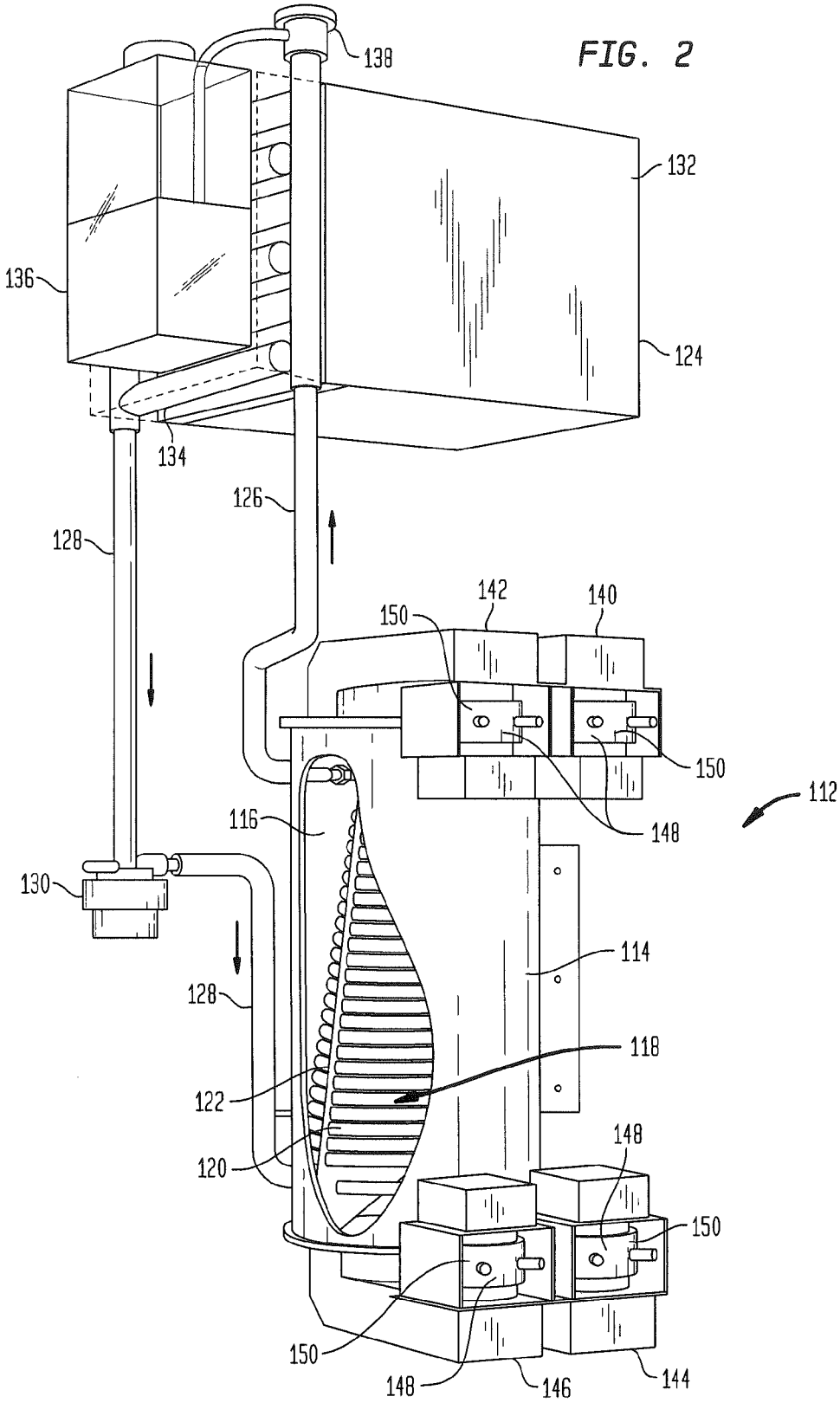
FIG. 2 is a perspective view of a magnetron heating system in accordance with one embodiment of the present invention adapted for heating a fluid supplied to a heat exchanger.

The heart of the heating system 102 is a magnetron heating system 112 as shown in FIG. 2 in accordance with one embodiment of the present invention. The magnetron heating system 112 includes a housing 114 defining an internal chamber 116 as shown through a cut out portion of the housing for illustration purposes. The housing 114 may be cylindrical in shape formed from a double wall construction having an air gap therebetween. The air gap provides radio frequency shielding from the electromagnetic energy created by the magnetrons, as well as thermal insulation. In the preferred embodiment, the housing 114 is constructed from stainless steel or other suitable materials.

A microwave transparent heating unit 118 is arranged within the internal chamber 116 of the housing 114. The heating unit 118 in the preferred embodiment is constructed from an elongated conduit such as tubing 120 formed into a conical shape by coiling having a smaller diameter at its upper end and a larger diameter at its lower end or vise versa. The coiled tubing 120 provides an exposed exterior surface area as shown in FIG. 2, and an exposed interior surface area within the internal space formed by the coiled tubing (not shown). The coiled tubing 120 provides a continuous fluid flow path from its lower end to its upper end extending along the length of the internal chamber 116. A tubing support 122 may be provided coupled to the coiled tubing 120 to maintain the tubing in its coiled conical shape. Although the heating unit 118 has been described in accordance with the preferred embodiment as having a conical shape, it is to be understood that other shapes such as cylindrical, oval, polygonal, and the like can be adopted for use in the magnetron heating system 112 of the present invention.

In accordance with one embodiment, the tubing 120 may be constructed from Teflon having an inside diameter of about 0.375 inches, although larger and smaller inside diameters are contemplated depending upon the size of the magnetron heating system 112 and its intended application. The preferred diameter of the tubular 120 allows complete heating of the tubing by exposure of its exterior and anterior surface areas to the electromagnetic energy generated by the magnetrons. In addition to Teflon, the tubing 120 can be constructed of glass or other microwave transparent materials. The advantage of Teflon versus other material is that Teflon has a high dielectric strength which makes it invisible to microwaves. Other advantages are the relatively low absorption of water by Teflon, which maintains its dielectric strength all the time, as well as having a relatively low thermal conductivity. This allows the heat generated by the electromagnetic energy to remain in the fluid flowing through the heating unit 118.

The heating unit 118 is in fluid communication with a liquid to air heat exchanger 124 by a fluid supply conduit 126 coupled to the upper end of the tubing 120 and a fluid return conduit 128 coupled to the lower end of the tubing. A circulatory pump 130 is provided within the return conduit 128 for circulating fluid between the microwave heating unit 118 and the liquid to air heat exchanger 124. The liquid to air heat exchanger 124 is constructed from a housing 132 having a plurality of interdigitated fluid conduits 134. One section of interdigitated conduits 134 is shown outside of the housing 132 for illustration purposes only. It is to be understood that the interdigitated conduits 134 are preferably contained within the housing 132. The microwave heating unit 118 and the liquid to air heat exchange 124, via the supply and return conduits 126, 128 form a closed fluid loop for the fluid being heated within the internal chamber 116 as the fluid flows through the tubing 120.

An expansion tank 136 is in fluid communication with the closed loop to accommodate expansion and contraction of fluid therein during the heating and cooling cycles of the magnetron heating system 112. The fluid within the magnetron heating system 112 may be any number of fluids, preferably nontoxic, such as water and the like. In the preferred embodiment, glycol can be used as the heating medium. The expansion tank 136 is in fluid communication with the supply conduit 126 and a pressure relief cap 138.

The fluid flowing through the tubing 120 within the internal chamber 116 is heated by a magnetron system generating electromagnetic energy in the form of microwaves. In the preferred embodiment, a pair of waveguides 140, 142 are coupled to the upper end of the housing 114 and a pair of waveguides 144, 146 are coupled to the lower end of the housing 114. A magnetron 148 is received within a housing 150 coupled to the end of each of the waveguides 140, 142, 144, 146. The waveguides direct the electromagnetic energy in the form of microwaves from the magnetrons 148 to the internal chamber 116 within the housing 114 at either the upper end or the lower end thereof. More particularly, the upper magnetrons 148 direct microwave energy through the upper waveguides 140, 142 to the external surface area of the heating unit 118 within the internal chamber 116. On the other hand, the lower magnetrons 148 direct microwave energy through the lower waveguides 144, 146 to the interior surface area of the heating unit 118 within the internal chamber 116. By directing microwaves to both the exterior and interior surface areas of the coiled tubing 120 forming the heating unit 118, heating of the fluid therein is more efficient by allowing absorption of electromagnetic energy over substantially the entire surface area of the tubing 120.

The present invention, in the preferred embodiment, has been described as being provided with a pair of upper and lower magnetrons 148. However, it is to be understood that the present invention may incorporate only a single upper magnetron 148 and a single lower magnetron for heating the fluid flowing through the tubing 120. Further, it is also contemplated that only one magnetron 148 can be incorporated into the magnetron heating system 112 of the present invention, arranged either at the upper or lower end of the microwave heating unit 118. Typical, magnetrons are available ranging from 600 watts to 3000 watts in capacity. The size and number of magnetrons will be determined by the size of the space to be heated using the heating system 100 when conditioning a volume of air in a room or the like. By way of example, it is contemplated that a 1500 to 2000 square foot facility will incorporate four magnetrons, each of 1000 watts, arranged as illustrated and described in FIG. 2. Likewise, the use of the heating system 100 for heating hot water will incorporate magnetrons of varied capacity and number depending upon the hot water demands of the application.

Figure 6:
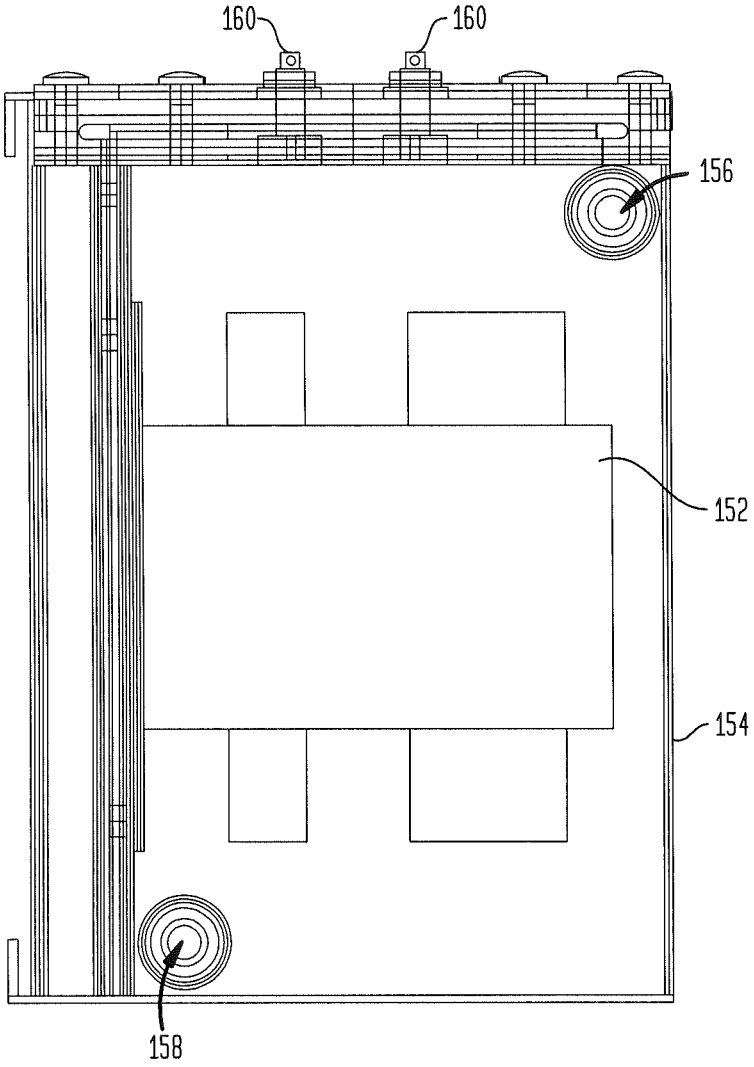
FIG. 6 is a cross-sectional view of the high voltage supply fluid cooling tank in accordance with one embodiment of the present invention.

Each of the magnetrons 148 are electrically coupled to a transformer 152 such as shown in FIG. 6. Referring to FIG. 6, the transformers 152 are preferably submerged in a cooling fluid contained within a transformer cooling tank 154 having a fluid inlet 156 and a fluid outlet 158. Each transformer 152 is electrically connected to a magnetron 148 via high voltage and line voltage terminals 160. Each tank 154 is filled with a cooling fluid such as mineral oil and the like. In the preferred embodiment as thus far described, a pair of transformers 152 for the upper magnetrons 148 will be submerged in a mineral oil bath within a single tank 154. Likewise, a pair of transformers 152 operably coupled to the lower magnetrons 148 will be submerged in a mineral oil bath within a single tank 154. However, it is contemplated that each of the transformers 152 may be immersed in separate cooling fluid tanks, or more than two transformers may be provided within a single tank.

By way of one example, each transformer is a high voltage transformer, 240V/60 Hz class 220 transformer. In a preferred embodiment, each transformer includes a thermal cutout in thermal contact with the transformer windings. This provides a safety feature in case of an oil cooling failure. The windings are also made to a higher heat standard than normal microwave transformers. In use, the upper and lower magnetrons 148 are pulsed using a half-wave voltage doubler. The upper magnetrons 148 are fired by the first half-wave of the line voltage and the lower magnetrons are fired by the second half-wave. This fires the magnetrons alternatively as opposed to simultaneously.

Figure 3:
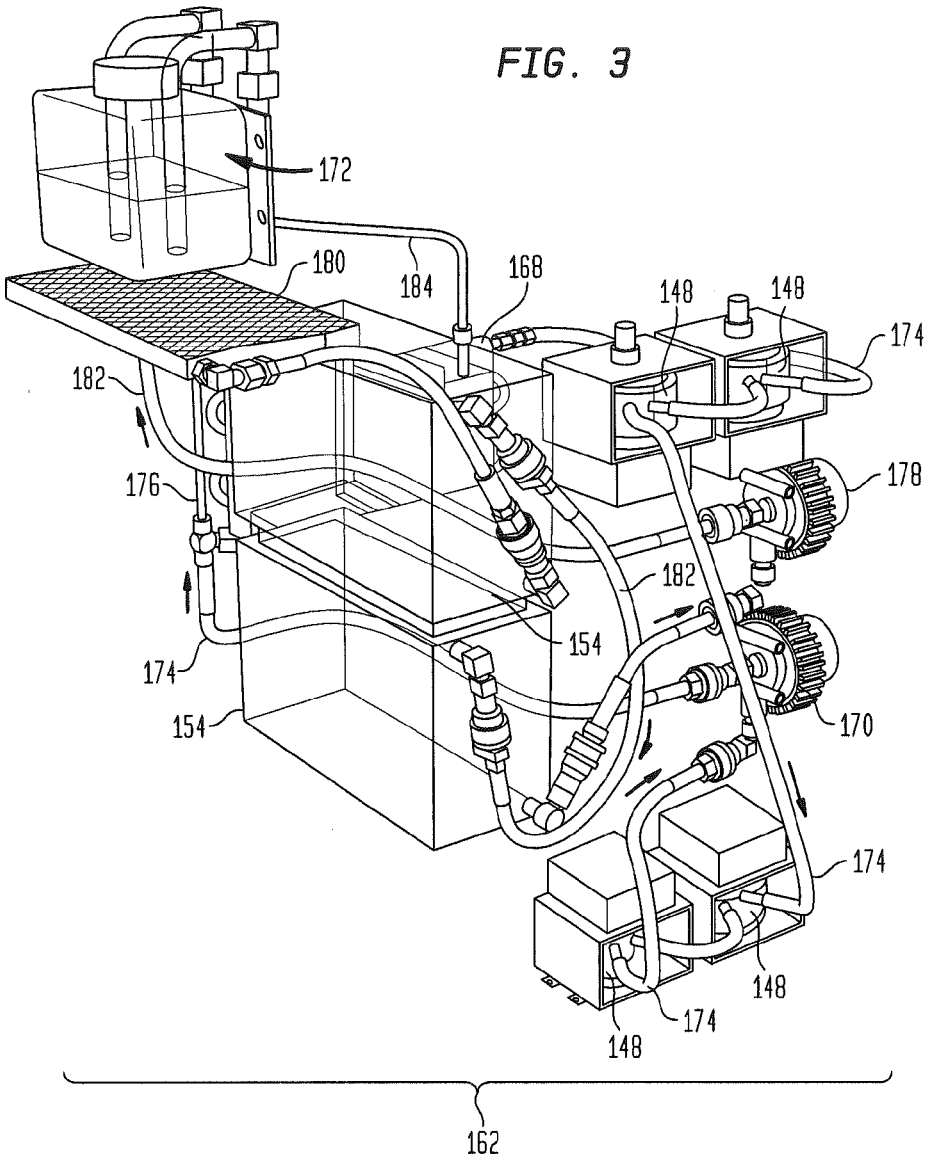
FIG. 3 is a perspective view of a magnetron and high voltage supply fluid cooling and recovery systems in accordance with one embodiment of the present invention.

Heat is generated within the housing 102 of the heating system 100 during operation of the magnetrons 148 and transformers 152. For the efficient operation of the heating system 100, it is preferred that the magnetrons 148 and transformers 152 be cooled, and that the heat be recovered for use in the heating system 100. For this purpose, the heating system 100 includes a magnetron and transformer fluid cooling and heat recovery system 162 as shown in FIG. 3. The cooling and heat recovery system 162 can be broken down into a magnetron fluid cooling system 164 as shown in FIG. 4 and a transformer fluid cooling system 166 as shown in FIG. 5.

Figure 4:
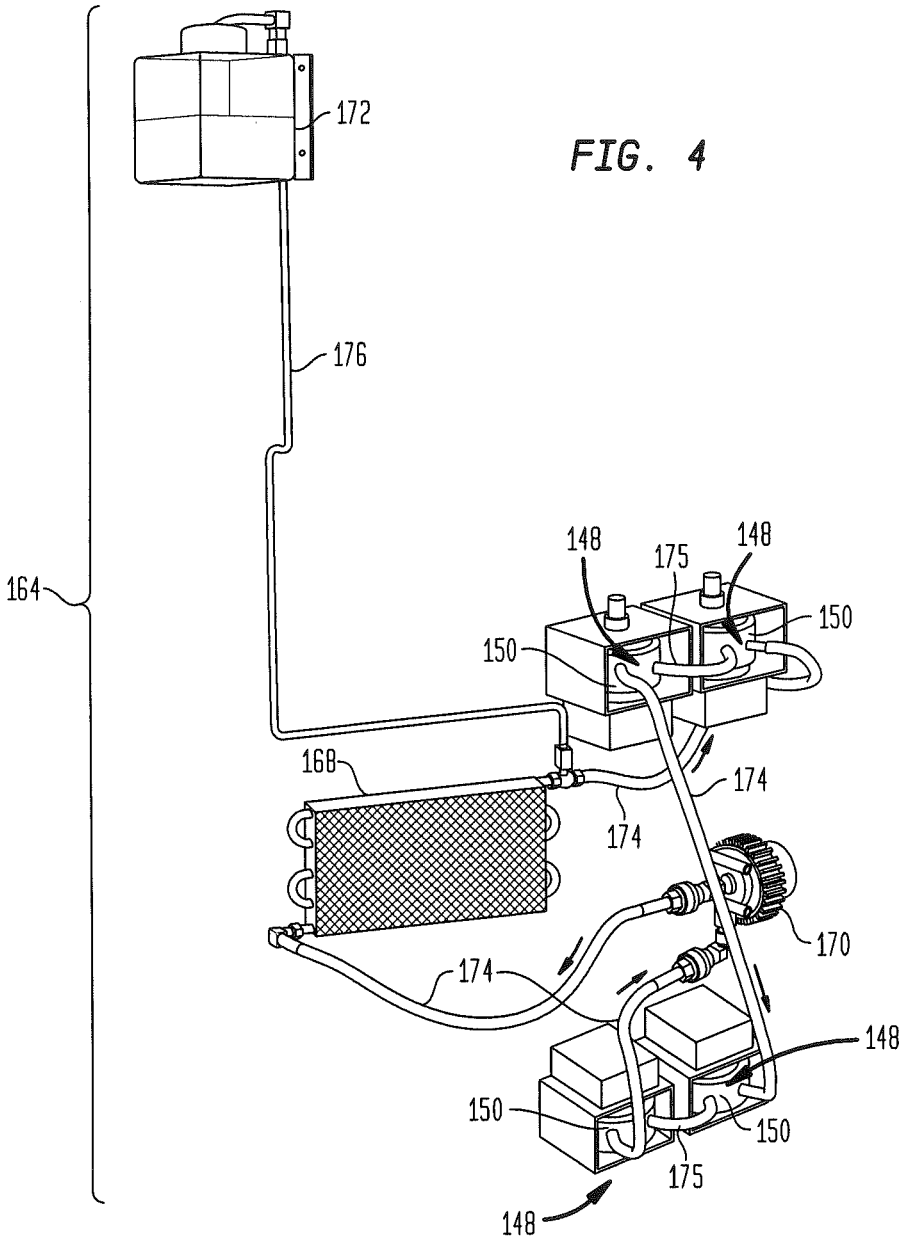
FIG. 4 is a perspective view of the magnetron fluid cooling and recovery system in accordance with one embodiment of the present invention.
Figure 5:
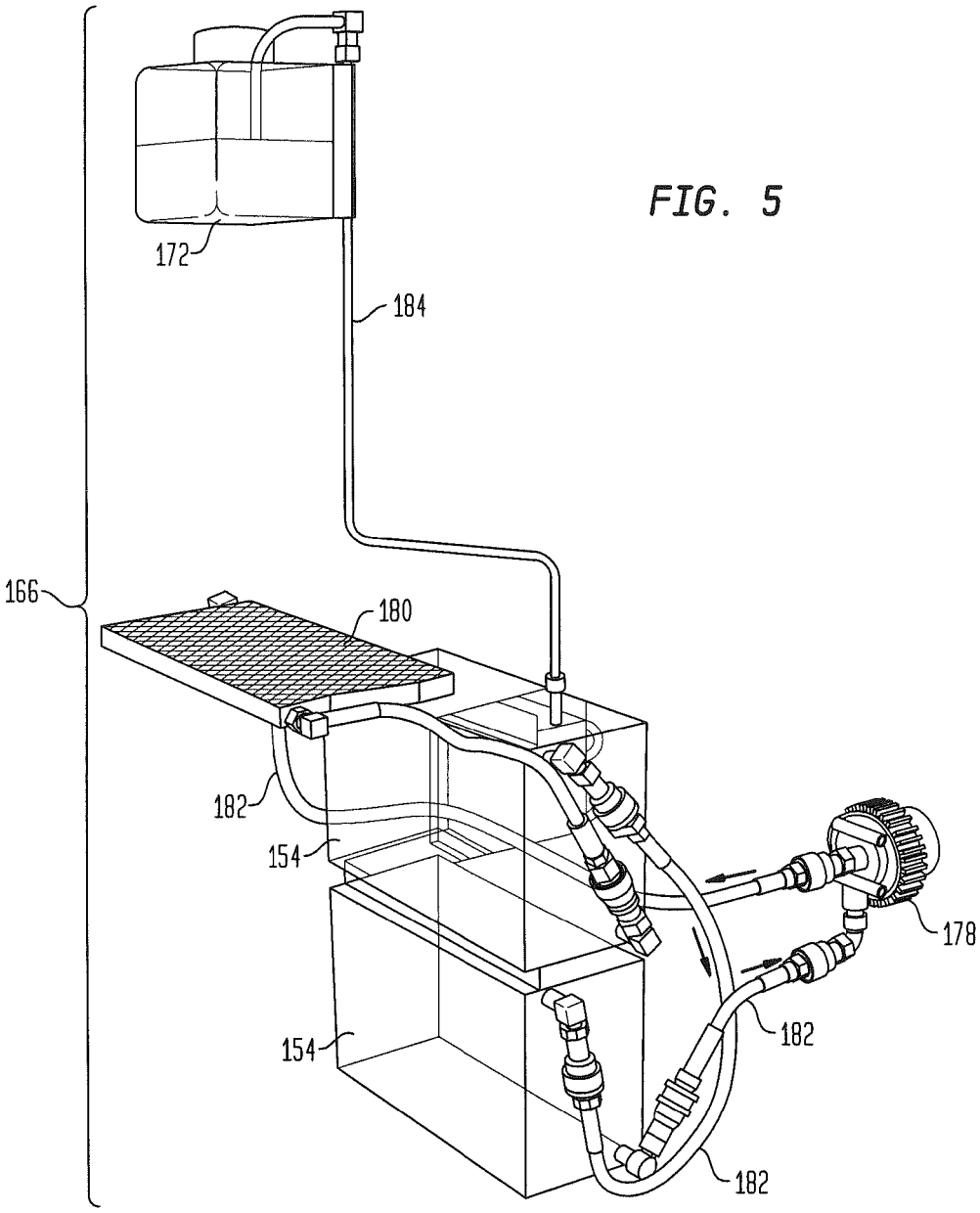
FIG. 5 is a perspective view of the high voltage supply fluid cooling and heat recovery system in accordance with one embodiment of the present invention.

Referring to FIGS. 3 and 4, the magnetron cooling system 164 includes a heat exchanger 168, a circulation pump 170, an optional expansion tank 172 and miscellaneous tubing 174 connecting the aforementioned components. The housings 150 for the upper magnetrons 148 are ganged together by tubing 175. Likewise, the housings 150 for the lower magnetrons 148 are ganged together by tubing 175. The pump 170 is operative for recirculating the cooling fluid such as mineral oil, glycol and the like contained within the housings 150 for the magnetrons 148 through the heat exchanger 168. The expansion tank 172 is in fluid communication via tubing 176 to the tubing 174 adjacent the heat exchanger 168. The magnetron cooling system 164 enables the recovery of heat generated by the magnetrons 148 via the heat exchanger 168 as to be described.

The transformer cooling system 166 includes the transformer tanks 154, pump 178, heat exchanger 180, an expansion tank 172 and tubing 182 interconnecting the components in fluid communication with each other. Tubing 184 couples the cooling fluid within one of the transformer tanks 154 to the expansion tank 172. The heat generated by the transformers 152 within the tanks 154 may be recovered by circulating the cooling fluid through the heat exchanger 180 as to be described. In the preferred embodiment, the transformers 152 are maintained at an operational temperature of about 210 degrees Fahrenheit by emersion within the cooling fluid within the tanks 154. The magnetron heating system 112 and cooling and heating recovery system 162 is arranged within the housing 102 as shown in FIGS. 7 and 8.

Figure 7:
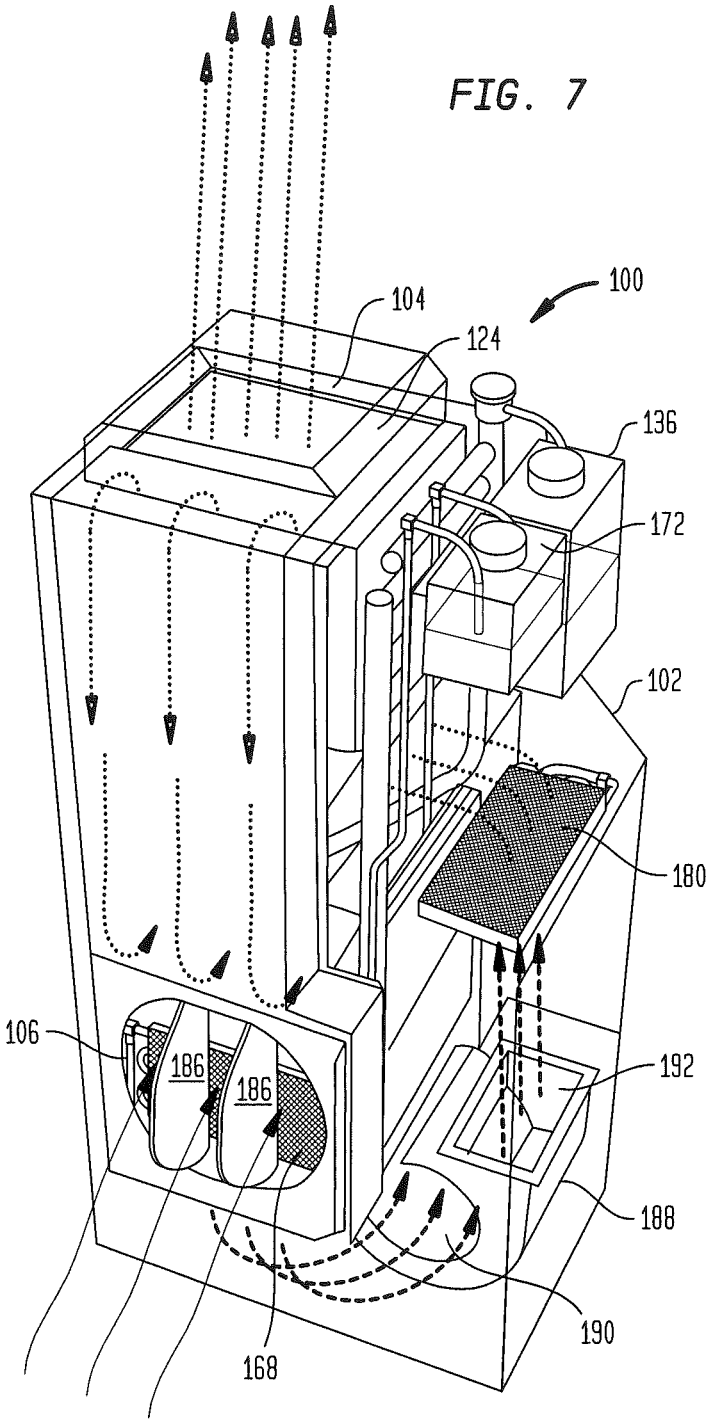
FIG. 7 is a perspective view showing the airflow path through the housing of the heating system as shown in FIG. 1 in accordance with one embodiment of the present invention.
Figure 8:
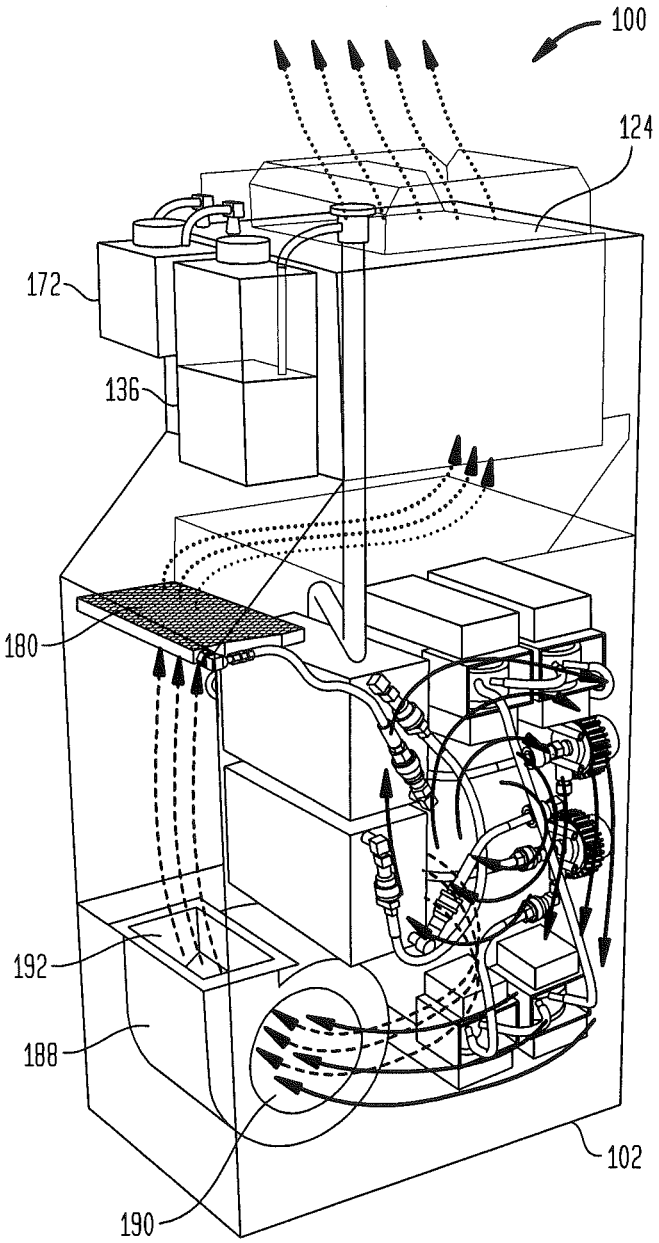
FIG. 8 is another perspective view showing the airflow path through the housing of the heating system as shown in FIG. 1 in accordance with one embodiment of the present invention.

Referring now to FIGS. 7 and 8, there will be described the assembly of the thus far described components within the housing 102 of the heating system 100. The air inlet 106 may be provided with one or more controlled baffles 186 or dampers for regulating the volume of return air flow into the heating system 100. A blower 188 has side air intakes 190 and an upwardly directed discharge opening 192. The magnetron cooling heat exchanger 168 is positioned opposing the air inlet 106 for heat recovery of the heat generated by the magnetrons during operation of the magnetron heating system 112. The transformer cooling heat exchanger 180 is arranged in the airflow path of the discharge opening 192 of the blower 188 for likewise heat recovery. The liquid to air heat exchange 124 is arranged underlying air outlet 104. The magnetron heating system 112 and transformer tanks 154 are located generally within the interior of the housing 102. As previously described, the housing 102 is preferably sealed but for the air outlet 104 and air inlet 106.

Return air is pulled through the air inlet 106 by the blower 188. The incoming air is circulated within the interior of the housing 102 picking up any internal heat from the magnetron heating system 112 and/or transformer tanks 154. The returning air is first conditioned by picking up heat from the magnetron heat exchanger 168, and thereafter, recovering heat from the transformer heat exchanger 180. The internally conditioned return air passed through the liquid to air heat exchanger 124 and is discharged through the air outlet 104. By the use of the magnetron heat exchanger 168 and transformer heat exchanger 180, the heat from operation of the transformers and magnetrons are dissipated directly into the path of the return air. The recovered heat from the aforementioned heat exchangers is directed into the airflow of the forced air through the air outlet 104 by means of the blower 188. The heating system 100 utilizes all consequential heat generated by the system components.

Figure 10:
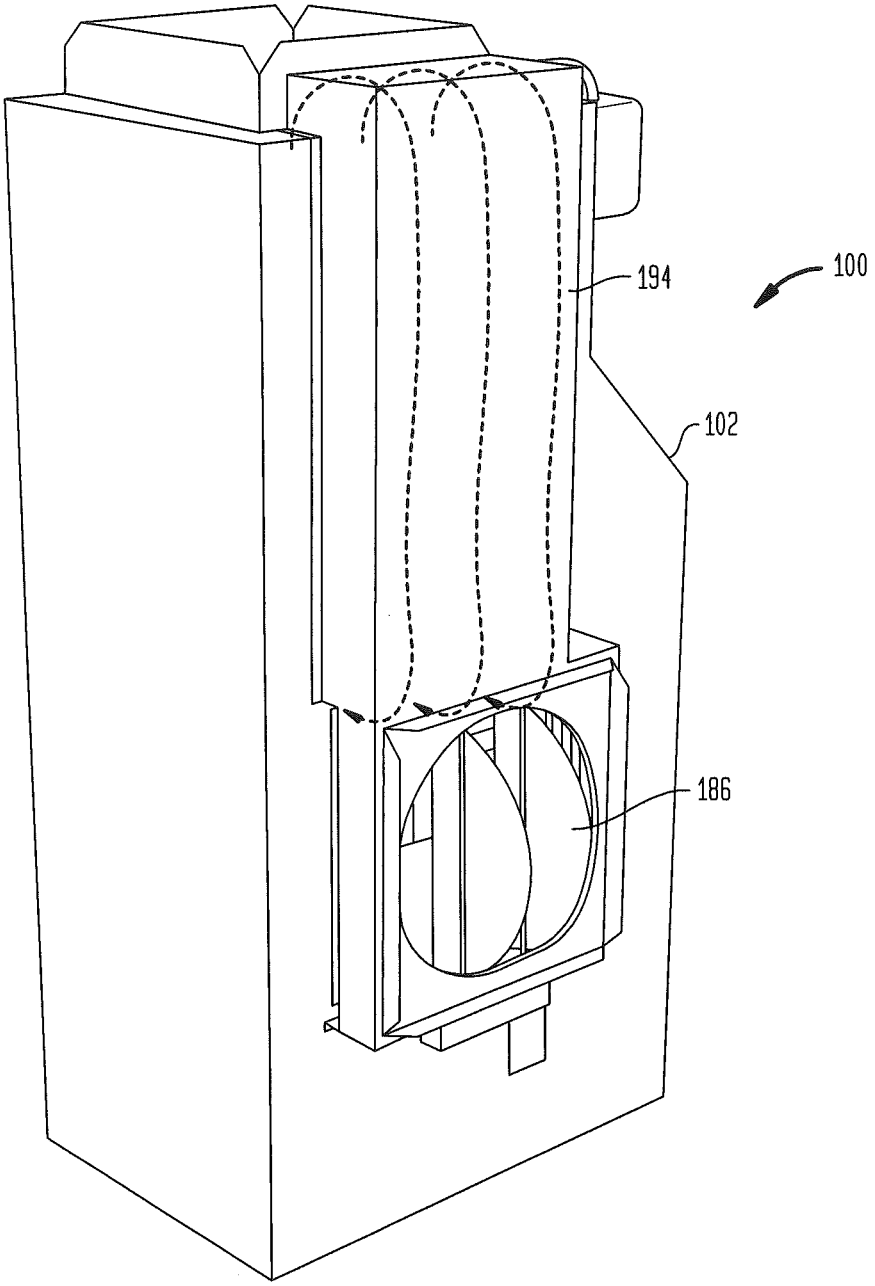
FIG. 10 is a perspective assembled view of the regenerative heat recovery duct shown in FIG. 9 in accordance with one embodiment of the present invention.

Referring to FIGS. 9 and 10, another embodiment of the present invention is described incorporating a forced air regeneration system. One principal of forced air regeneration is to return a portion of the outlet hot air through the return air inlet 106 using temperature controlled baffles or dampers. This approach decreases the time required to preheat the heating system 100 to operating temperature. In addition, it allows the heating system to maintain a higher temperature at the air outlet 104 during operation by approximately 10 degrees Fahrenheit or higher in accordance with one embodiment.

The forced air regeneration system includes a regenerative heat recovery duct 194. The duct 194 includes a return air inlet 196 having an opening controlled by the dampers 186 via a servo control unit 198. The duct 194 is mounted to the housing 102 with air inlet 196 arranged in alignment with air inlet 106 for controlling the return air to the heating system 100. The duct 194 has an air inlet 200 arranged at its upper end in communication with the interior of the housing 102 and an air outlet 202 also in communication with the interior of the housing via air inlet 106. Regenerative heat directed into the air inlet 200 from within the housing 102 passes through the duct 194 and is discharged into the cold air return by air outlet 202. As previously described, the cold air return through the air inlets 106, 196 is controlled by the temperature controlled dampers 186.

The heat regeneration system described above thus directs a portion of the outlet heat back to the cold air return. This system uses the butterfly dampers 186 in the cold air return which are controlled by heat sensors located in the cooling and/or returned liquid from the liquid to air heat exchanger 124. When the system requires more preheated air, the dampers 186 restrict cold air return to draw more heated air into the system. This system yields approximately a 10 degree Fahrenheit increase in outlet temperature. This will maintain an outlet temperature of about 150 degrees Fahrenheit with a liquid to air heat exchanger 124 temperature of about 140 degrees Fahrenheit.

By combining the magnetron heating system 112 and the cooling and heat recovery systems 162 in a sealed housing 102, this provides a heat retention system which allows the heating system 100 to operate using minimum power. The heating system 100 is controlled by a microprocessor that constantly monitors all operating parameters of the heating system to maximize efficiency under all conditions. In operation, the heat recovery system directs the heat removed by the magnetron cooling system 164 and transformer cooling system 166 into the warm airflow of the heating system 100, prior to the liquid to air heat exchanger 124. This process recovers approximately 95 percent of the power lost to heat.

The heat retention system, which includes the magnetron cooling system 164 and the transformer cooling system 166, is maintained at approximately 200 degrees Fahrenheit during operation. Upon restart at the next heating cycle, the oil within the heat retention system will be at least approximately 180 degrees Fahrenheit. The maintained heat is immediately directed back into the warm airflow of the heating system 100. This provides rapid return to operating temperature at the next start up.

The overall effect of the heating system 100 in accordance with the present invention is increased efficiency and comfort control of the heated area. This can be achieved by incorporating a number of the above described features of the present invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An electromagnetic energy heating system, comprising:

a housing forming an internal chamber in communication with an air inlet and an air outlet, an airflow path provided within the housing in communication with the air inlet and air outlet;

a fluid heating unit arranged within the chamber for heating a fluid within the fluid heating unit;

a magnetron for creating electromagnetic energy in communication with the fluid heating unit for heating the fluid in the fluid heating unit;

a transformer operably connected to the magnetron for the operation of the magnetron for creating electromagnetic energy;

a cooling system comprising a first circulation system for circulating cooling fluid between the magnetron and a magnetron heat exchanger, the magnetron heat exchanger arranged in communication with the airflow path; and a second circulating system for circulating cooling fluid between the transformer and a transformer heat exchanger, the transformer heat exchanger arranged in communication with the airflow path; and a blower for directing air passing over the magnetron heat exchanger and the transformer heat exchanger through the airflow path to the air outlet.

2. The heating system of claim 1, wherein the first circulation system comprises a housing for the magnetron containing a cooling fluid therein, and a pump for circulating the cooling fluid between the housing and the magnetron heat exchanger.

3. The heating system of claim 1, wherein the second circulation system comprises a tank containing therein a cooling fluid and the transformer, and a pump for circulating the cooling fluid between the tank and the transformer heat exchanger.

4. The heating system of claim 3, wherein the transformer is immersed within the cooling fluid.

5. The heating system of claim 1, wherein the fluid heating unit includes a coiled conduit having an interior surface area and an exterior surface area, the coiled conduit having an upper end and a lower end, wherein the magnetron is arranged adjacent the upper end for directing electromagnetic energy over the exterior surface area, and further comprising another magnetron arranged adjacent the lower end for directing electromagnetic energy over the interior surface area.

6. The heating system of claim 5, wherein the first circulating system comprises a first housing for the magnetron adjacent the upper end of the coiled conduit and a second housing for the magnetron adjacent the lower end of the coiled conduit, the first and second housings containing a cooling fluid therein, and a pump for circulating the cooling fluid between the first and second housings and the magnetron heat exchanger.

7. The heating system of claim 6, wherein the transformer is operably connected to the magnetron adjacent the upper end of the coiled conduit, and further comprising another transformer operably connected to the magnetron adjacent the lower end of the coiled conduit.

8. The heating system of claim 7, wherein the second circulating system comprises a first tank containing therein a cooling fluid and one of the transformers and a second tank containing the cooling fluid and the other of the transformers, and a pump for circulating the cooling fluid between the first and second tanks and the transformer heat exchanger.

9. The heating system of claim 8, wherein the blower is arranged within the housing operable for forcing air received from the air inlet over the magnetron heat exchanger and the transformer heat exchanger prior to being discharged from the air outlet of the housing.

10. The heating system of claim 9, further including a recirculation duct adapted for recirculating a portion of air passing over the transformer heat exchanger to the air inlet of the housing.

11. The heating system of claim 1, further including a liquid to air heat exchanger arranged in communication with the air outlet.

12. An electromagnetic energy heating system comprising;

a housing forming an internal chamber;

a heating unit having a fluid therein, the heating unit formed from a coiled conduit containing the fluid and having a conical shape within the chamber, the coiled conduit having an exterior surface area and an interior surface area, the coiled conduit including an upper end having a diameter smaller than a diameter of a lower end of the coiled conduit, the lower end having an opening in communication with the interior surface area of the coiled conduit;

a double wall chamber containing the coiled conduit, the double wall chamber arranged within the internal chamber of the housing;

a first magnetron for creating electromagnetic energy directed toward the exterior surface area of the coiled conduit for heating the fluid therein; and a second magnetron for creating electromagnetic energy directed toward the interior surface area of the coiled conduit for heating the fluid therein.

13. The heating system of claim 12, further including a first waveguide adapted for directing electromagnetic energy from the first magnetron to the coiled conduit at the upper end and a second waveguide adapted for directing electromagnetic energy from the second magnetron to the coiled conduit at the lower end.

14. The heating system of claim 13, further including a fluid to air heat exchanger in communication with the fluid within the coiled conduit.

15. The heating system of claim 13, further including a first transformer in operable communication with the first magnetron and a second transformer in operable communication with the second magnetron, the first and second transformers arranged within at least one tank containing a cooling fluid, a transformer heat exchanger in communication with the cooling fluid and, a pump for circulating the cooling fluid between the tank and the transformer heat exchanger.

16. The heating system of claim 15, further including a magnetron heat exchanger in communication with a cooling fluid adapted for cooling the first and second magnetrons, and a pump for circulating the cooling fluid between the magnetron heat exchanger and the first and second magnetrons.

17. An electromagnetic energy heating system, comprising:

a housing forming an internal chamber in communication with an inlet and an outlet;

a fluid heating unit within the chamber for heating a fluid within the fluid heating unit;

first and second magnetrons for creating electromagnetic energy in communication with the fluid heating unit for heating the fluid;

first and second transformers operably connected to a respective one of the first and second magnetrons for the operation of the magnetrons; and a cooling system comprising a first circulation system for circulating cooling fluid between the first and second magnetrons and a magnetron heat exchanger, and a second circulating system for circulating cooling fluid between the first and second transformers and a transformer heat exchanger;

wherein the fluid heating unit includes a coiled conduit having an interior surface area and an exterior surface area, the coiled conduit having an upper end and a lower end, wherein the first magnetron is arranged adjacent the upper end for directing electromagnetic energy over the exterior surface area, and wherein the second magnetron is arranged adjacent the lower end for directing electromagnetic energy over the interior surface area; and wherein the first circulating system comprises a first housing for the first magnetron adjacent the upper end of the coiled conduit and a second housing for the second magnetron adjacent the lower end of the coiled conduit, the first and second housings containing a cooling fluid therein, and a pump for circulating the cooling fluid between the first and second housings and the magnetron heat exchanger.

18. An electromagnetic energy heating system, comprising:

a housing forming an internal chamber in communication with an air inlet and an air outlet, an air passageway provided in communication with the air inlet and the air outlet;

a fluid heating unit within the chamber for heating a fluid within the fluid heating unit;

a first magnetron for creating electromagnetic energy in communication with the fluid heating unit for heating the fluid within the fluid heating unit;

a first transformer operably connected to the first magnetron for the operation of the first magnetron for creating electromagnet energy;

a second magnetron for creating electromagnetic energy in communication with the fluid heating unit for heating the fluid within the fluid heating unit;

a second transformer operably connected to the second magnetron for the operation of the second magnetron for creating electromagnet energy; and a cooling system comprising:

a first circulation system for circulating cooling fluid between the first and second magnetrons and a magnetron heat exchanger arranged in communication with the air passageway, the first circulation system comprising the magnetron heat exchanger, a circulation pump and first tubing interconnecting the first and second magnetrons with the magnetron heat exchanger and first circulation pump; and a second circulating system for circulating cooling fluid between the first and second transformers and a transformer heat exchanger arranged in communication with the air passageway, the second circulation system comprising the transformer heat exchanger, a circulation pump and second tubing interconnecting the first and second transformers with the transformer heat exchanger and second circulation pump.

19. The heating system of claim 18, wherein the first circulation system is independent from the second circulation system.

* * * * *

UNITED STATES PATENT AND TRADEMARK OFFICE

CERTIFICATE OF CORRECTION

PATENT NO. : 8,901,468 B2
APPLICATION NO. : 13/445399
DATED : December 2, 2014
INVENTOR(S) : Vincent A. Bravo It is certified that error appears in the above-identified patent and that said Letters Patent is hereby corrected as shown below:

In the Claims

Column 10, line 36, Claim 18, “electromagnet energy” should read --- electromagnetic energy ---.
Column 10, line 42, Claim 18, “electromagnet energy” should read --- electromagnetic energy ---.

Signed and Sealed this
Fourth Day of August, 2015

Michelle K. Lee

Michelle K. Lee
*Director of the United States Patent and Trademark Office*